US006678607B2

(12) United States Patent
Akins et al.

(10) Patent No.: US 6,678,607 B2
(45) Date of Patent: Jan. 13, 2004

(54) MACHINE FLUID PRESSURE INDICATION SYSTEM

(75) Inventors: Mark Akins, Columbus, IN (US); Scott Thompson, Columbus, IN (US); Robert Smalley, II, Columbus, IN (US); Daniel G. Showalter, Columbus, IN (US); Bryan Williams, Hope, IN (US); Greg Smith, Elletsville, IN (US); Eric Holloway, Lafayette, IN (US)

(73) Assignee: Cummins Inc., Columbus, IN (US)

( * ) Notice: Subject to any disclaimer, the term of this patent is extended or adjusted under 35 U.S.C. 154(b) by 64 days.

(21) Appl. No.: 10/153,107

(22) Filed: May 22, 2002

(65) Prior Publication Data

US 2003/0220733 A1 Nov. 27, 2003

(Under 37 CFR 1.47)

(51) Int. Cl.[7] ..... G06F 19/00

(52) U.S. Cl. ..... 701/114; 123/196 S; 123/198; 184/108

(58) Field of Search ..... 701/100, 101, 701/102, 103, 104, 105, 110, 113, 114, 115, 116; 123/196 R, 196 S, 198 D; 73/49.7; 184/108

(56) References Cited

U.S. PATENT DOCUMENTS

| | | | | |
|---|---|---|---|---|
| 5,070,832 A | | 12/1991 | Hapka et al. | |
| 5,466,054 A | * | 11/1995 | Okazaki | 303/150 |
| 5,540,209 A | * | 7/1996 | Hasegawa et al. | 123/679 |
| 5,742,920 A | | 4/1998 | Cannuscio et al. | |
| 5,941,305 A | * | 8/1999 | Thrasher et al. | 166/53 |
| 5,968,107 A | | 10/1999 | Vogan et al. | |
| 6,041,856 A | * | 3/2000 | Thrasher et al. | 166/53 |
| 6,112,150 A | | 8/2000 | Irons et al. | |
| 6,196,174 B1 | | 3/2001 | Wada et al. | |

* cited by examiner

*Primary Examiner*—John Kwon
(74) *Attorney, Agent, or Firm*—Woodard, Emhardt, Moriarty, McNett & Henry, LLP

(57) ABSTRACT

A system, method and apparatus are disclosed for creating a signal that indicates the pressure of the fluid in an engine. A switch or sensor determines whether the actual pressure is greater or less than a threshold pressure. If the actual pressure is less than the threshold pressure, a sensed pressure (e.g., the output of a pressure sensor) is used. If the sensed pressure is greater than the threshold pressure, then the output is derived from an estimate of the fluid pressure, where the estimate is based on other operating parameters of the engine. The output signal can be used as an input to a display visible by an operator, controller logs, diagnostic systems, and the like.

10 Claims, 5 Drawing Sheets

MACHINE FLUID PRESSURE INDICATION SYSTEM

BACKGROUND

The present invention relates to the measuring of operating parameters in machines. More specifically, the present invention relates to measuring fluid pressure using a combination of measured and estimated values. Present measurement techniques suffer from cost problems and/or a misplacement of sensor resolution (that is, a low resolution within an area of interest, or a high resolution in ranges outside the area of interest). In some of these systems, such inefficient approaches add significant cost to the system design but realize very little benefit for the machine operator.

In one such example, a vehicle presented its operator with a display of the oil pressure in the engine, either in the form of a simple binary indicator light or small analog gauge. In this prior art system, the oil pressure was measured with sensors having good range and resolution, but the data produced by those sensors was used only to drive very basic output devices. Much of the information in the sensor's output signal was, therefore, discarded with little or no benefit to the design and operation thereof. That is, even though the system used sensors with good resolution over their whole operating range, that resolution was important only in a small portion of that range and wasted in the remainder of the range.

There is thus a need for further contributions and improvements to engine fluid measurement technology. The present invention satisfies this need in a novel and nonobvious manner.

SUMMARY

One object of the present invention to provide an improved fluid characteristic measurement technique, system, and method.

This object and others are achieved by various forms of the present invention. One aspect of the present invention is a method for use in an engine having a first fluid, the operation of the engine being characterized by one or more operating parameters, comprising sensing whether the first fluid pressure is greater than or less than a threshold pressure. If the first fluid pressure is sensed to be greater than the threshold pressure, one or more engine operating parameters are used to estimate the first fluid pressure, and the estimated oil pressure is output. If, on the other hand, the first fluid pressure is sensed to be less than the threshold pressure, a detected pressure of the first fluid is output. In one embodiment of this aspect, the engine operating parameter(s) comprise the engine revolution rate and a temperature of a second engine fluid (such as a lubricant or coolant). In other embodiments, the first fluid is oil.

In another aspect of the present invention, an apparatus comprises a pressure switch with a first output signal that indicates a pressure below a threshold pressure and a second output signal that indicates a pressure above the threshold pressure. An oil pressure sensor outputs a sensed pressure output signal, and an oil pressure estimator outputs an estimate signal. A multiplexer is configured to receive these signals and (1) output the sensed pressure output signal in response to the first output signal, and (2) output the estimate signal in response to the second output signal.

In yet another aspect of the present invention, a system comprises one or more oil pressure sensors that produce a sensed pressure signal that reflects a detected oil pressure; an estimating means for producing an estimated pressure signal; and a selection means in communication with the sensors and the estimating means, wherein the selection means outputs an output signal (1) based on the sensed pressure signal when the detected oil pressure is less than a predetermined threshold, and (2) based on the estimated pressure signal when the detected oil pressure is greater than the predetermined threshold. In some embodiments of this aspect of the invention, the selection means is an analog multiplexor, while in other embodiments, the selection means is a digital multiplexor. In still further embodiments, a controller executes software to control the engine, and the selection means is a conditional operation in the software.

DESCRIPTION OF THE ILLUSTRATED EMBODIMENTS

Figure 1:
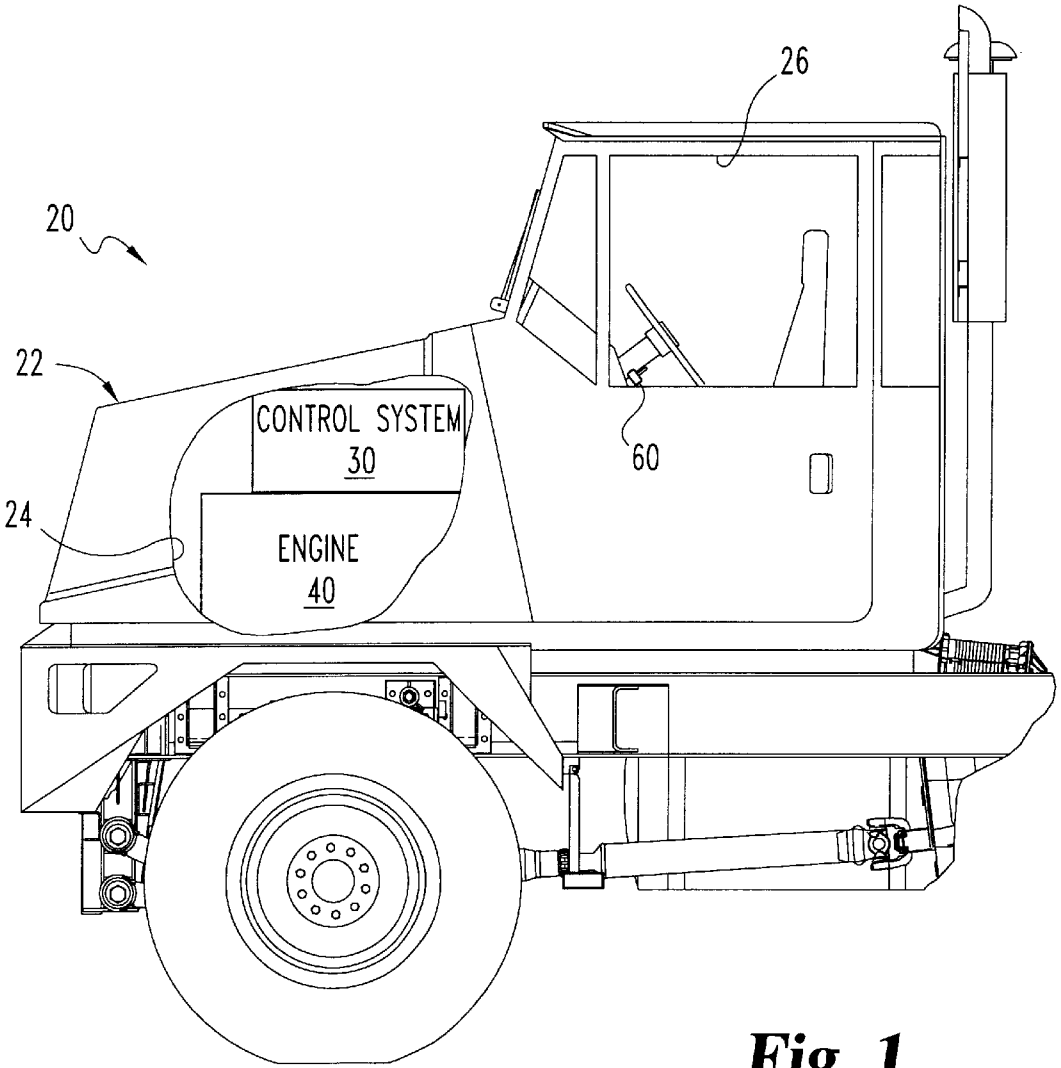
FIG. 1 is a partial cutaway view of selected physical components in one embodiment of the present invention.

For the purpose of promoting an understanding of the principles of the present invention, reference will now be made to the embodiment illustrated in the drawings and specific language will be used to describe the same. It will, nevertheless, be understood that no limitation of the scope of the invention is thereby intended; any alterations and further modifications of the described or illustrated embodiments, and any further applications of the principles of the invention as illustrated therein are contemplated as would normally occur to one skilled in the art to which the invention relates.

Figure 2:
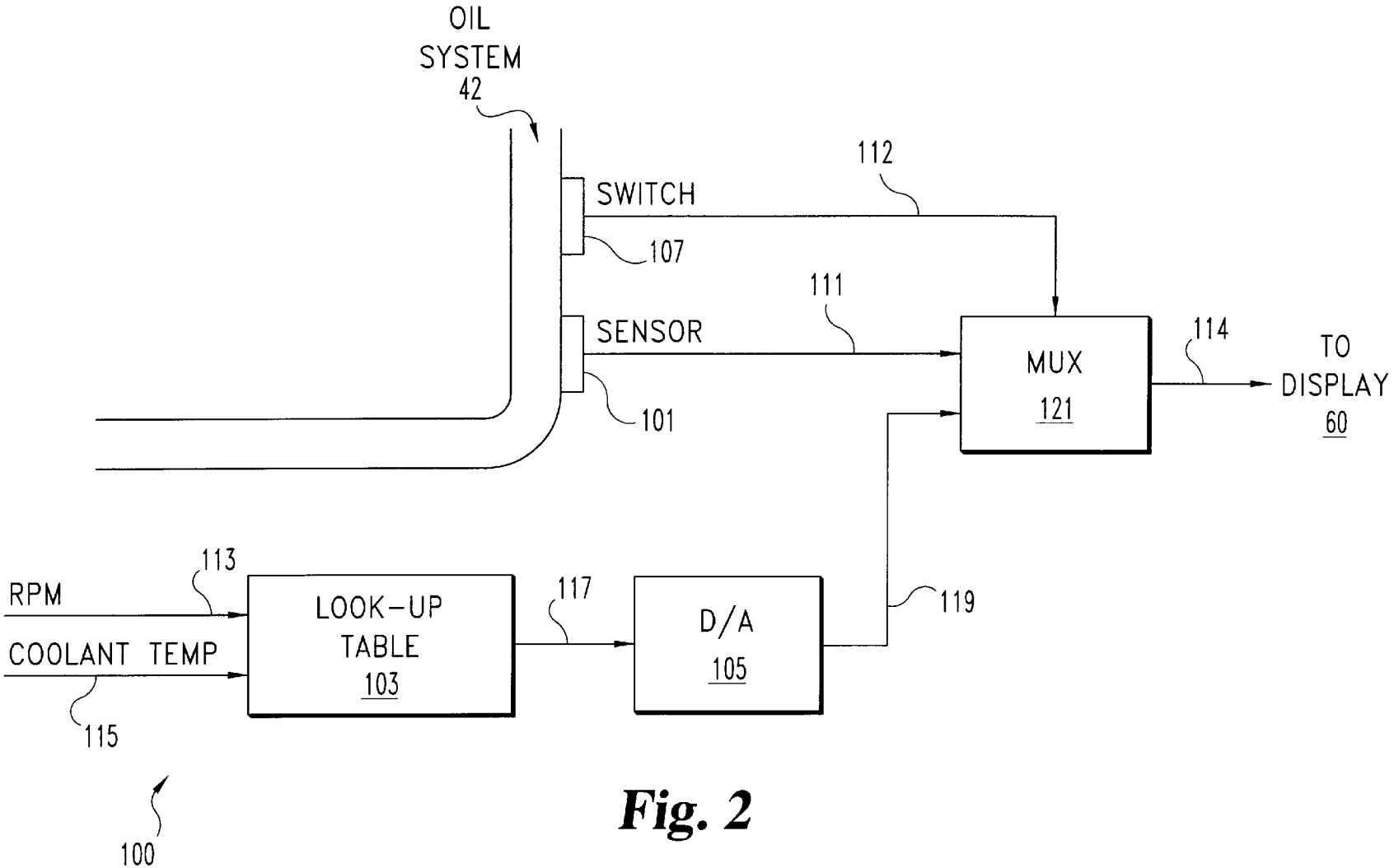
FIG. 2 is a schematic diagram of an analog-output oil pressure sensing system according to one embodiment of the present invention.

Generally, the oil pressure monitoring system illustrated in FIGS. 1 and 2 uses a pressure switch to select between an actual sensed pressure signal and an estimated pressure signal (which is based on engine speed and coolant temperature). The selected signal is output to an operator display gauge or other device.

The context of one embodiment of the inventive system, method, and apparatus will now be discussed in relation to FIG. 1. System 20 includes a ground transport vehicle 22 with engine compartment 24 and vehicle operator compartment 26. A cutaway of engine compartment 24 reveals a schematically depicted control system 30 and internal combustion engine 40. Control system 30 monitors and regulates operation of engine 40, which is the primary source of motive power for vehicle 22. In vehicle operator compartment 26, a display 60 visible by an operator in operator compartment 26 may be integrated into the dash of the vehicle, affixed to the dash, projected onto a heads-up display (HUD), or presented in another form as would occur to one skilled in the art.

An analog-signal embodiment of the present invention will now be discussed with reference to FIG. 2 and continuing reference to FIG. 1. Generally, FIG. 2 illustrates system 100 providing an analog signal to display 60 of the pressure in oil system 42 within engine 40. Sensor 101 detects the pressure in oil system 42 and provides an analog signal that indicates the sensed pressure on wire 111 to multiplexer (MUX) 121. A signal on wire 113 indicating the engine speed (for example, in revolutions per minute (RPM)), and a signal on wire 115 indicating the engine coolant temperature combine as inputs to look-up table 103. Look-up table 103 outputs an estimated oil pressure value in digital form on wire 117. Digital-to-analog converter 105 changes the digital estimated pressure signal on wire 117 to analog form and puts that analog signal on wire 119 to MUX 121.

Pressure-sensitive switch 107 detects whether the actual oil pressure $P_A$ in oil system 42 is above or below a threshold pressure $P_T$. If $P_A>P_T$, switch 107 puts a first signal (for example, 0 VDC) on conductor 112, while if $P_A<P_T$, switch 107 puts a second signal (for example, 5 VDC) on wire 112. MUX 121 uses the signal on wire 112 to select between the signals provided on wires 111 and 119, and places the selected signal on wire 114 for use by display 60.

MUX 121 and its inputs are configured so that when $P_A<P_T$, the output of sensor 101 (on wire 111) is sent through as the output signal $P_O$ to wire 114. Conversely, when $P_A>P_T$, MUX 121 uses the analog signal reflecting an estimated pressure (on wire 119) to generate the signal on wire 114.

Depending on design criteria, hardware selection, other criteria, or arbitrary choice, either the first signal or the second signal may be present on wire 112 when $P_A=P_T$, with the corresponding selection being affected as discussed above. At that oil system pressure ($P_A=P_T$), signals presented to MUX 121 on wires 111 and 119 are preferably equal (see the discussion below in relation to FIG. 5). That is, the output signal indicated by $P_O$ on wire 114 preferably reflects a continuous function of $P_A$ over the domain of pressures sought to be detected.

A controller-based implementation of the present invention will now be discussed in relation to FIG. 3 with continuing reference to the elements of system 20 shown in FIG. 1. In this embodiment, controller 201 communicates with memory 203 to store and retrieve data and programming instructions in order to monitor and control both other elements of control system 30 and the operation of engine 40. In this embodiment, a digital signal that indicates a sensed pressure is received by controller 201 on line 211. Similarly, digital values representing engine speed and coolant temperature are received on lines 213 and 215, respectively. Controller 201 retrieves and executes programming instructions from memory 203 to detect whether the sensor output 211 indicates pressure $P_S$ greater than or less than a threshold pressure $P_T$. If $P_S<P_T$, controller 201 places a digital signal representing the sensed pressure $P_S$ on wire 214 for use by display 60.

On the other hand, if $P_S>P_T$, then controller 201 generates an estimated pressure $P_E$ based on the engine speed signal (on wire 213) and the coolant temperature (on wire 215). Such calculation may be implemented in the form of a look-up table, a calculated function (such as a linear combination) of the inputs, or other technique as would appear to one skilled in the art. A digital signal representing the estimated pressure $P_E$ is placed on wire 314 for use by display 60.

Figure 3:
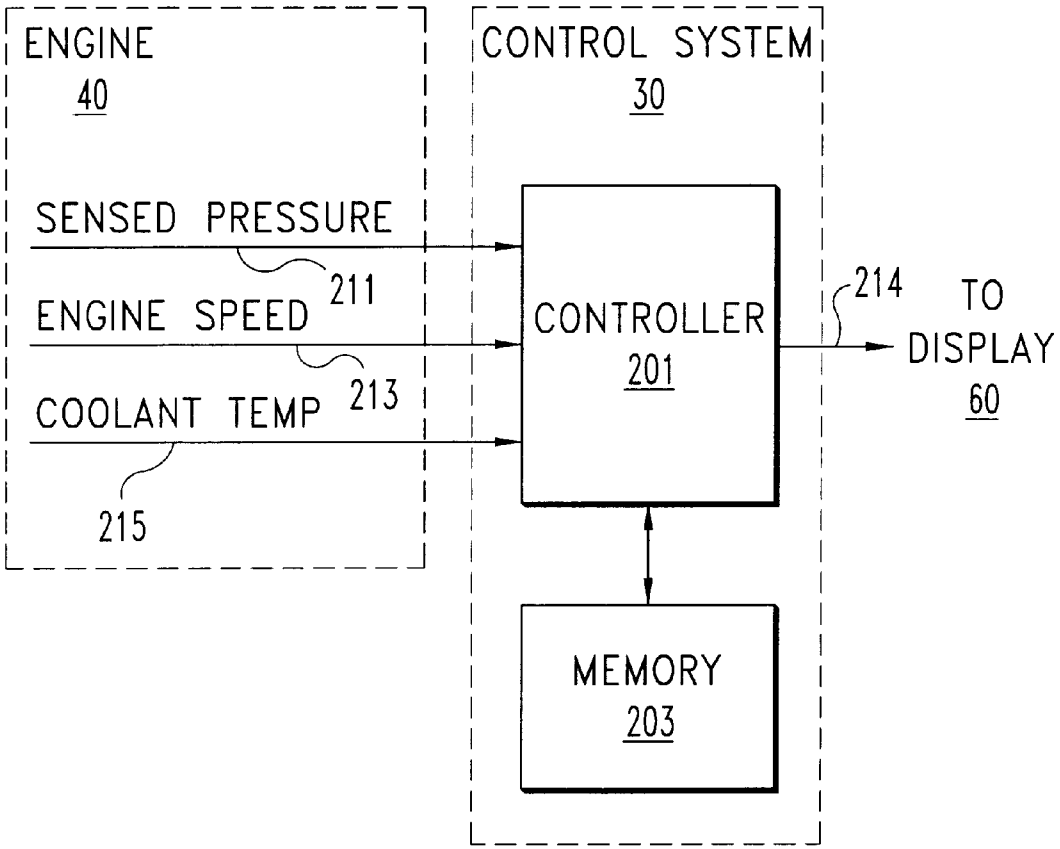
FIG. 3 is a schematic diagram of a controller-based, digital-output embodiment of the present invention.

In some embodiments resembling the embodiment shown in FIG. 3, the operating parameters that serve as inputs in the estimating process are acquired, calculated, determined, or otherwise found for other purposes by one or more components of control system 30 and/or engine 40. In such embodiments, one or more of the pressure sensor signal, the engine speed signal, and coolant temperature signal may simply be read from memory 203 or one or more registers within controller 201.

Memory 203 can include one or more types of solid-state electronic memory, magnetic memory, or optical memory, just to name a few. By way of non-limiting example, memory 203 can include solid-state electronic Random Access Memory (RAM), Sequentially Accessible Memory (SAM) (such as the First-In, First-Out (FIFO) variety or the Last-In First-Out (LIFO) variety), Programmable Read Only Memory (PROM), Electrically Programmable Read Only Memory (EPROM), or Electrically Erasable Programmable Read Only Memory (EEPROM); an optical disc memory (such as a DVD or CD-ROM); a magnetically encoded hard disk, floppy disk, tape, or cartridge media; or a combination of any of these memory types. Also, memory 203 can be volatile, nonvolatile, or a hybrid combination of volatile and nonvolatile varieties.

Figure 4:
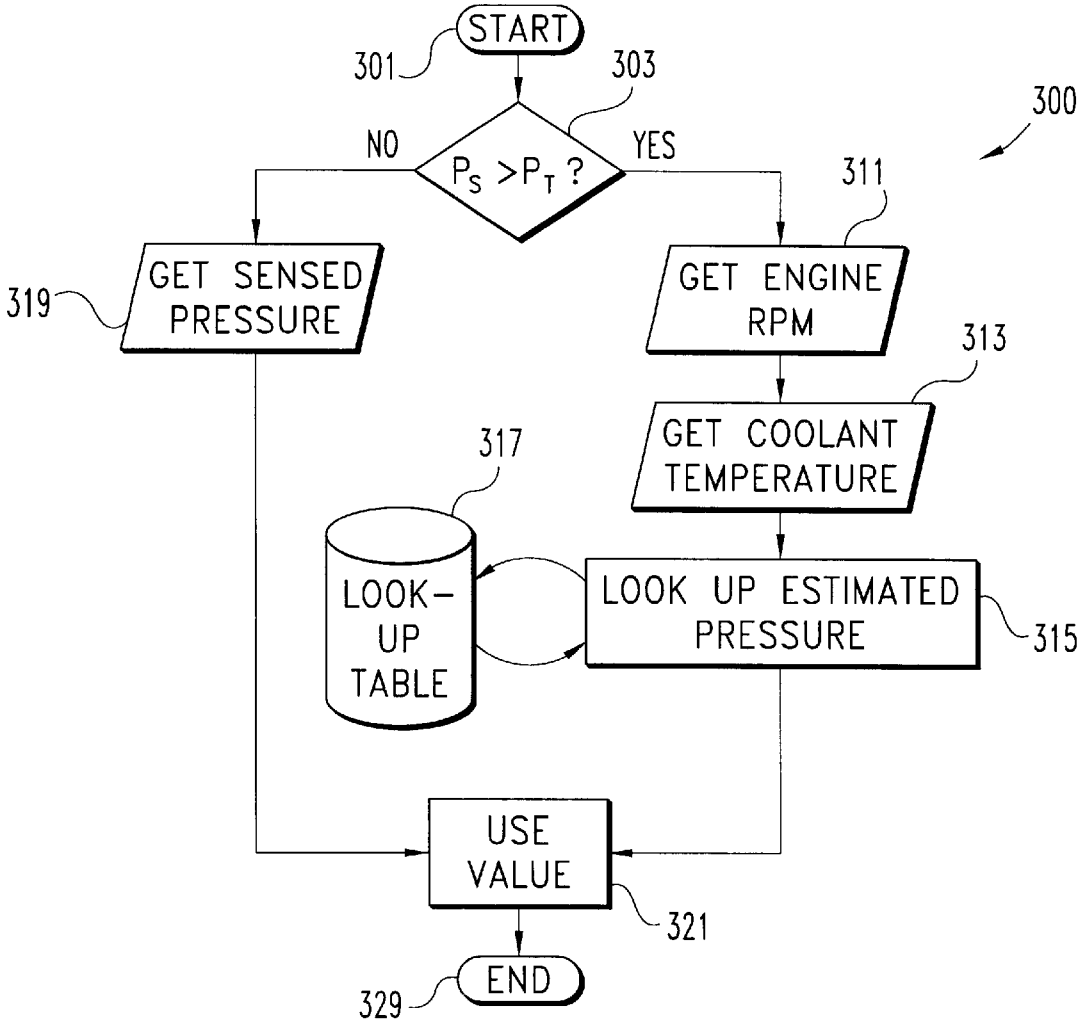
FIG. 4 is a flow chart illustrating a fluid pressure-sensing method according to the present invention.

The logical process 300 followed by one embodiment to the present invention will now be discussed in relation to FIG. 4. Process 300 begins at START point 301 and proceeds to decision block 303, where it is determined whether the sensed pressure $P_S$ is greater than a predetermined threshold pressure $P_T$.

If $P_S>P_T$(positive result at decision block 303), then signals reflecting the engine speed and coolant temperature are obtained at input blocks 311 and 313, respectively. These values are used at block 315 as inputs to a query of look-up table 317, which outputs an estimated pressure signal. This signal is used in block 321 for one or more purposes, such as showing the vehicle operator using display 60, data logging applications, and the like. The process then ends at END point 329.

If it is determined at decision block 303 that $P_S<P_T$ (negative result), a value indicative of the sensed pressure is obtained at input block 319. Then that value is used at block 321, and the process ends at END point 329.

Figure 5:
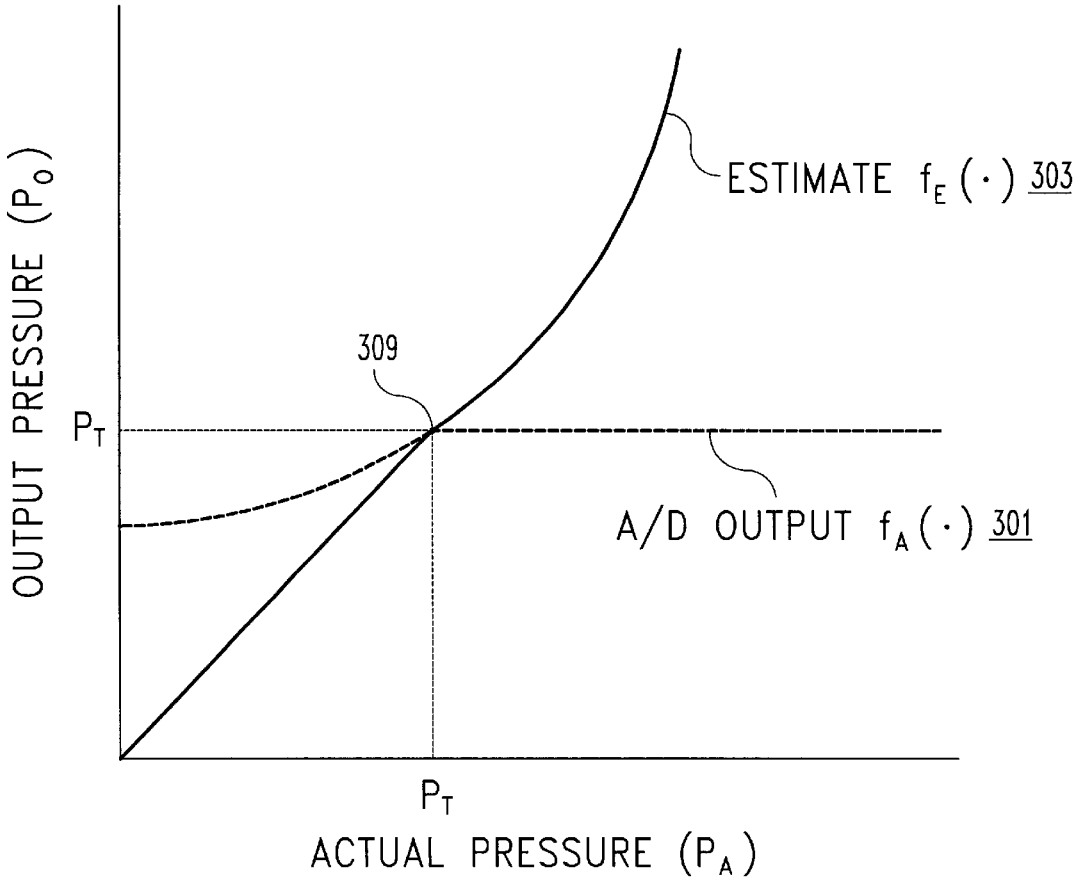
FIG. 5 is a graph illustrating hypothetical A/D output and estimate functions as they relate to output from some embodiments of the present invention.

FIG. 5 shows one possible combination of sensed input, estimated input, and output functions. In this example, an analog-to-digital converter has output values that, at their maximum, reflect a pressure of $P_T$. In addition, the pressure-estimating function of operating parameters is non-linear such that, for actual pressures $P_A<P_T$, the estimate is somewhat inaccurate, but for $P_A \geqq P_T$, the estimate is fairly accurate.

Using the system or method of the present invention, an accurate output is obtained over the whole domain of actual pressures to be sensed. In the present example, for actual pressures $P_A<P_T$, output pressure $P_O$ follows the A/D output function $f_A(\cdot)$ 301. For $P_A>P_T$, the output pressure $P_O$ follows pressure estimate function $f_E(\cdot)$ 303. In this example, $f_A(P_T)=f_E(P_T)$ (intersection point 309) so when $P_A=P_T$, either $f_A(\cdot)$ or $f_E(\cdot)$ may be used. In other embodiments, $f_A(P_T)\neq f_E(P_T)$, so $f_A(\cdot)$, $f_E(\cdot)$, $\frac{1}{2}(f_A(\cdot)+f_E(\cdot))$, a predetermined value, or another value may be used at $P_A=P_T$.

It is noted that in any of the illustrated embodiments more or fewer components or signals might be used as would occur to one skilled in the art. For example, sensor outputs may be conditioned, data signals may appear in and be converted between analog and digital forms, quantifications and/or encodings may be applied, and so on. As another example, two or more sensors, processors, memory, or other hardware components may be integrated into one or more microchips.

In various embodiments of the invention, one or more engine parameters other than engine speed and coolant temperature are used to estimate the fluid pressure. For example, transmission gear status, transmission speed, oil temperature, ambient temperature, vehicle speed, and the like. In other embodiments, different fluid pressures may be detected (other than oil pressure, which was detected in the illustrated embodiments). For example, such embodiments might generate signals that reflect tire pressure, coolant pressure, and the like.

Furthermore, the output value of the selection process (on wire 114 in FIG. 2, on wire 214 in FIG. 3, or the value used in block 321 in FIG. 4) may be used in one or more ways. For example, a simple two-state indicator light may be shown to an operator, a graduated or non-graduated gauge may display the output value to the operator, the value may be used in engine data logs, the output value stream can be used as feedback in the control system 30 for engine 40, and/or the data can be an input to diagnostic or prognostic operations (not shown).

While the invention has been illustrated and described in detail in the drawings and foregoing description, the same is to be considered as illustrative and not restrictive in character, it being understood that only the preferred embodiments have been shown and described and that all changes and modifications that would occur to one skilled in the relevant art are desired to be protected. It should also be understood that while the use of the word "preferable," "preferably," or "preferred" in the description above indicates that the feature so described may be more desirable in some embodiments, it nonetheless may not be necessary, and embodiments lacking the same may be contemplated as within the scope of the invention, that scope being defined only by the claims that follow. In reading the claims it is intended that when words such as "a," "an," "at least one," "at least a portion," and the like are used, there is no intention to limit the claim to exactly one such item unless specifically stated to the contrary in the claim.

What is claimed is:

1. In an engine having a first fluid, the operation of the engine being characterized by one or more operating parameters, a method comprising:

sensing whether the first fluid pressure is greater or less than a threshold pressure;

if the first fluid pressure is sensed to be greater than the threshold pressure, using engine operating parameters to estimate the first fluid pressure and outputting the estimated oil pressure; and if the first fluid pressure is sensed to be less than the threshold pressure, outputting a detected first fluid pressure.

2. The method of claim 1, wherein the one or more engine operating parameters comprise the engine revolution rate and a temperature of a second engine fluid.

3. The method of claim 2, wherein the second engine fluid is a lubricant.

4. The method of claim 2, wherein the second engine fluid is a coolant.

5. The method of claim 1, wherein the first fluid is oil.

6. An apparatus, comprising:

a pressure switch having a first output signal that indicates a pressure below a threshold pressure and a second output signal that indicates a pressure above the threshold pressure;

an oil pressure sensor that outputs a sensed pressure output signal;

an oil pressure estimator that outputs an estimate signal; and a multiplexor configured to receive the first output signal, the second output signal, the sensed pressure output signal, and the estimate signal;

output the sensed pressure output signal in response to said first output signal; and output the estimate signal in response to said second output signal.

7. In an engine, a system comprising:

one or more oil pressure sensors that produce a sensed pressure signal that reflects a detected oil pressure;

an estimating means for producing an estimated pressure signal; and a selection means in communication with said one or more sensors and said estimating means, wherein said selection means outputs an output signal:

based on the sensed pressure signal when the detected oil pressure is less than a predetermined threshold, and based on the estimated pressure signal when the detected oil pressure is greater than the predetermined threshold.

8. The apparatus of claim 7, wherein said selection means is an analog multiplexer.

9. The apparatus of claim 7, wherein said selection means is an digital multiplexer.

10. The apparatus of claim 7, wherein a controller executes software to control the engine; and said selection means is a conditional operation in the software.

* * * * *